United States Patent [19]

Salomon

[11] 4,166,635

[45] Sep. 4, 1979

[54] DEVICE FOR HOLDING A BOOT TO A SPORTS ARTICLE

[75] Inventor: Georges P. J. Salomon, Annecy, France

[73] Assignee: Etablissements Francois Salomon et Fils, Annecy, France

[21] Appl. No.: 793,617

[22] Filed: May 4, 1977

[51] Int. Cl.[2] ..... A63C 9/10; A63C 9/085

[52] U.S. Cl. ..... 280/625; 248/505; 269/321 ME; 280/618; 280/631

[58] Field of Search ..... 280/631, 632, 617, 618, 280/619, 620, 625, 605, 11.37 E, 615, 614; 24/265 R; 248/505, 510; 269/321 CF, 321 ME

[56] References Cited

U.S. PATENT DOCUMENTS

| | | | |
|---|---|---|---|
| 3,489,424 | 1/1970 | Gertsch et al. | 280/618 |
| 3,918,732 | 11/1975 | Wulf | 280/618 |
| 4,017,098 | 4/1977 | Kirsch | 280/625 |

FOREIGN PATENT DOCUMENTS

| | | | |
|---|---|---|---|
| 171853 | 7/1952 | Austria | 280/631 |

*Primary Examiner*—David M. Mitchell

*Attorney, Agent, or Firm*—Pollock, Vande Sande & Priddy

[57] ABSTRACT

A device for holding an object (such as a boot) to a support (such as a ski) is provided with a resilient member to furnish energy to hold the object to the support, the resilient member having two parallel pivoting parts spaced from each other and housed in the support, these pivoting parts being united by a resiliently deformable loop.

19 Claims, 9 Drawing Figures

DEVICE FOR HOLDING A BOOT TO A SPORTS ARTICLE

The present invention relates to a device for holding an object, more particularly a boot, to a means of support such as a ski, the device holding the boot to the support with sufficient force to prevent the boot and support from becoming separated, while also making a safety release possible.

The invention relates more particularly to the holding of an object between two parts, at least one of which is movable in relation to the other, one of the parts being a means of support for the object, more particularly a ski, while the other is a pressure part attached to the means of support and designed to be applied to the object to be held, the device comprising, furthermore, a resilient means acting between the two elements movable in relation to each other and designed to apply to the object, through one of the elements, an intermediate resilient force in a specific direction.

Holding devices meeting the above definition are already known, but the designs thereof are relatively complex since they call for a large number of parts moving in relation to each other, especially hinged or sliding supports governed by one or more springs, in addition to stops designed to limit the movement of the various parts.

Such structurally complex devices are naturally expensive to manufacture, and the larger the number of parts moving in relation to each other, the greater the risk of malfunction.

It is an object of the present invention to eliminate these disadvantages by providing a holding device of simple and rugged design which requires a minimum of parts moving in relation to each other, and which is characterized mainly in that the resilient means used in the holding device according to the invention comprises at least:

two pivoting parts accommodated in one of the two elements on axes arranged substantially parallel with, and spaced from each other;

and a connecting part uniting the pivoting parts and connecting them to the other element.

While the element constituting the support means has a longitudinal axis extending in the direction in which the object is to be held, the axes of the pivoting parts may extend at right angles to the said axis and may be located, according to a first embodiment, in a plane parallel with that of the element constituting the support means.

According to one particularly simple embodiment of the invention, the element constituting the pressure part is integral with the connecting part of the resilient means uniting the pivoting parts. More particularly, the resilient means and pressure part may be in the form of a single rod shaped to provide a central loop running above the plane of the support means and two parallel pivoting sections extending the loop on each side, the pivoting sections being arranged to pivot in respective housings provided in the support means.

In this way, the shaped-rod unit, when mounted upon the support means, is in stable equilibrium, and any action upon one part of the rod involves a reversible resilient deformation of at least one part thereof.

Where the device according to the invention is to be used to hold the front part of a boot, it is desirable for the transverse portion of the central loop to be raised above the ski and to act as the pressure part proper, the transverse portion being extended by two arms substantially perpendicular to each of the pivoting parts.

According to another embodiment, the device according to the invention may serve as a stop for the front of the boot, permitting lateral release. In this case, the device consists of two independent shaped rods arranged upon each side of the longitudinal axis of the support means. In this embodiment, it is desirable that the pressure part be in the form of an extension of at least one of the pivoting parts.

The device according to the invention may also comprise a jaw which is movable in relation to the support means and is designed to cooperate with the rear of the boot, the jaw being urged into a specific position by a resilient means consisting of at least one rod shaped to provide a central loop terminating in two cylindrical sections parallel with, and spaced from, each other. Depending on the circumstances, the pivoting sections may be mounted on the support means, while the central loop holds the jaw and allows it to pivot or, if the central loop is allowed to pivot upon the means of support, the jaw is mounted upon two pivoting sections.

In any case, and in all possible embodiments, the power allowing the pressure part to apply a holding force to the boot is provided by resilient deformation of a rod shaped to present a stable condition.

It will be noted that the loop, with its sections, could with advantage be shaped in such a manner that the fact of mounting it upon the support means produces a pre-load by displacement of the sections. However, this pre-load is not indispensable, and it is possible to mount the resilient means in such a manner that the spacing of these pivoting sections on the support means is identical with that existing when the resilient means is removed from the support means.

A description will now be given, as non-restrictive examples, of a plurality of embodiments of the invention, with reference to the drawings attached hereto, wherein.

As already indicated, these variants of the device according to the invention may be used to adapt the retaining system by automatic control to various types of boots, especially to cover soles of different thicknesses, or to obtain lateral, vertical, or longitudinal retention of the boot, with or without safety release.

It should be noted that the device according to the invention may be used, either directly upon a ski or upon an intermediate plate fitted temporarily under the boot and releasable, in relation to the ski, by means of bindings of conventional design, or for any object requiring retention, more particularly for drilling templates for fitting bindings to a ski, for ice crampons, for supports for transporting boots, for roller skates, for ice skates, etc.

However, for the purpose of explaining the invention clearly, it will be assumed herein that the device cooperates with a means of support which is a ski.

Figure 1:
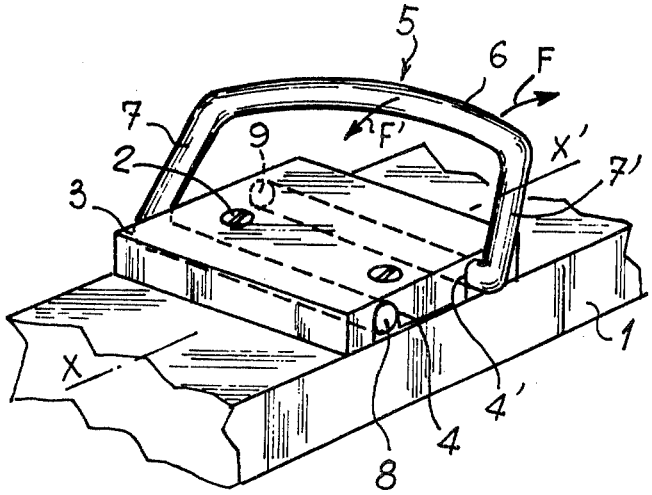
FIG. 1 illustrates a first embodiment of the invention designed, more particularly, to hold the front of the boot with no release.

In FIG. 1, reference 1 indicates a part of the ski to which a base plate 3 is secured by means of screws 2, the baseplate having two housings of circular cross-section running at right angles to the longitudinal axis XX' of the ski. The housings are therefore parallel with, and spaced from, each other by a specific distance.

A cylindrical rod, generally denoted 5, is shaped to provide a transverse central portion 6 extended by two arms 7,7' bent in such a manner that end-sections 8,9 extend parallel with the inside of housing 4,4' in the base plate, in which they are free to turn. Transverse portion 6, designed to serve as a pressure part, is therefore raised above the plane of the ski when in neutral position. Shaped rod 5 thus presents a stable position which allows the ski to be put on.

It will be understood that it is merely necessary to engage the tip of the boot in the loop formed by transverse portion 6 and arms 7,7'; the thrust of the boot against loop 6 thus tends to depress it in the direction of arrow F. However, pivots 8 and 9, as a result of their special arrangement, will resiliently oppose this displacement in the direction of arrow F and will tend to restore loop 6 to its initial position, thus applying to the sole of the boot a force F' in a direction opposite to that of arrow F.

As may be seen in FIG. 1, sections 8,9 are in a plane parallel with the plane of the ski, whereas arms 7,7' are not.

Figure 2:
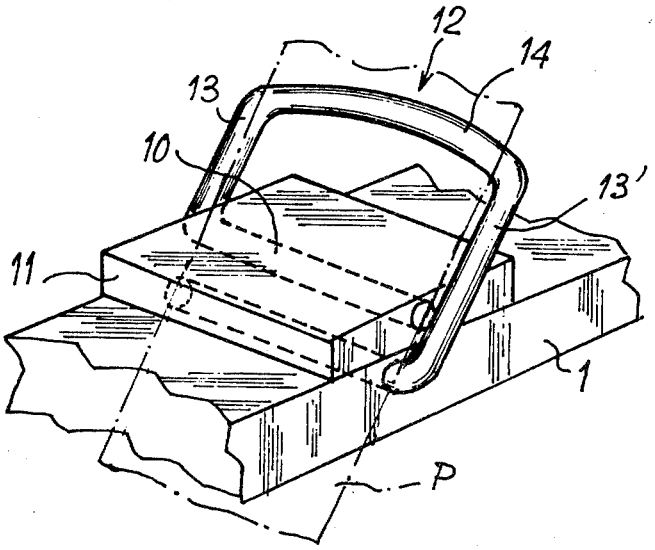
FIG. 2 shows a variant of the device illustrated in FIG. 1.

On the other hand, in the embodiment illustrated in FIG. 2, end-sections 10,11 of shaped rod 12 are at all times parallel but are located in a plane P forming an angle with the upper plane of ski 1.

As shown in FIG. 2, arms 13,13' and cross member 14 of the shaped rod may also be located in plane P, but it will be understood that this need not be so.

The method of operation of the device in FIG. 2 is identical with that of the device in FIG. 1.

Figure 3:
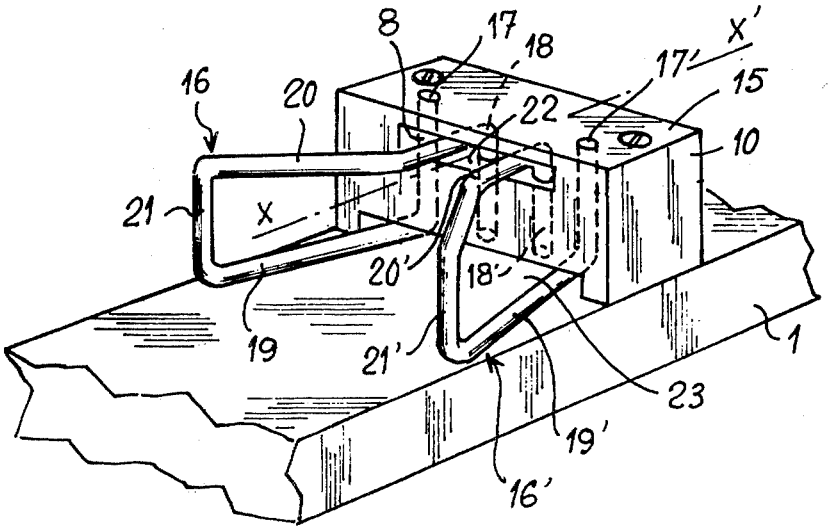
FIG. 3 illustrates an embodiment designed to hold the front of the boot and to provide for a safety release.
Figure 4:
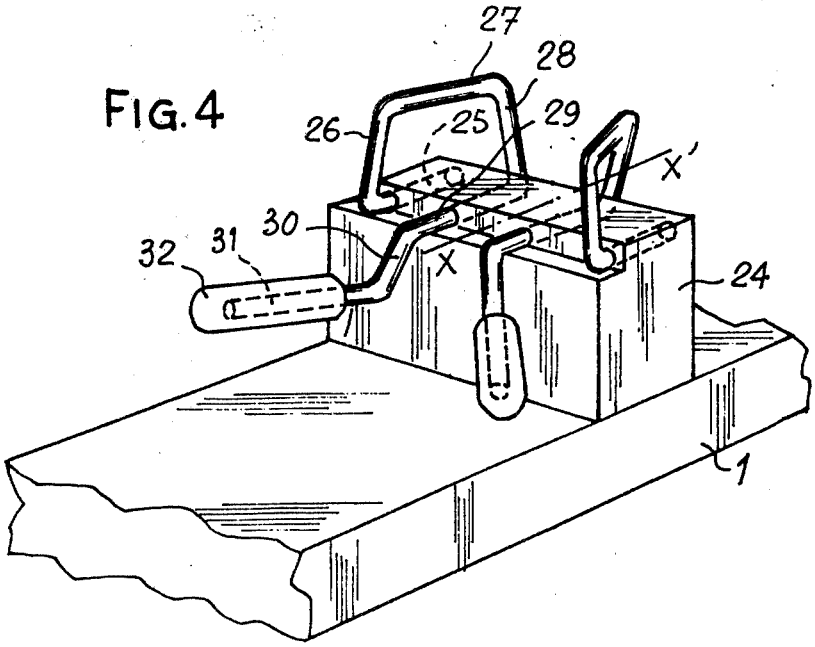
FIG. 4 is another embodiment of a device designed to hold the front of the boot and to provide for a safety release.

FIGS. 3 and 4 are two embodiments of a device according to the invention which holds the front of the boot and makes lateral release possible.

According to FIG. 3, a substantially vertical plate 15 is secured to ski 1, the plate supporting, on each side of the longitudinal axis XX' of the ski, two symmetrically shaped rods 16,16'. Each of these rods has two end-sections 17,17' and 18,18' arranged to pivot vertically in respective housings in plate 15. These pivoting sections are thus located in a plane perpendicular to the plane of the ski and at right angles to axis XX'.

End-sections 17,18 and 17', 18' are connected by a substantially vertical loop having a lower arm 19,19' and an upper arm 20,20', arms 19 and 20 being united by a central portion 21, and arms 19' and 20' being united by a central portion 21'. Plate 15 is provided with an upper aperture 22 allowing upper arms 20,20' to pass. Plate 15 also has a lower aperture 23 through which lower arms 19 and 19' can pass and in which the arms can move.

The front of the sole of the boot is engaged in loops 16,16' in such a manner that upper arms 20,20' bear against the upper part of the sole, whereas central portions 21, 21' bear against the vertical portion of the sole. The front part of the boot is thus held vertically and laterally.

Release of the boot in the event of torsion in the plane of the ski is produced by resilient deformation and displacement of one of loops 16,16'.

It should be noted that one variant (not shown) makes it possible to use a single rod instead of two, by eliminating sections 17,17' and connecting arms 19,19' by a horizontal crosspiece.

FIG. 4 shows another embodiment of the device according to the invention which also holds the front of the boot and provides for lateral release thereof.

This embodiment also comprises two shaped rods mounted in a vertical plate 24, running transversely of the ski, and being symmetrical in relation to the longitudinal axis XX' thereof.

A detailed description will now be given of one of the shaped rods, for instance the left-hand rod in FIG. 4.

The rod has an end-section 25 arranged to pivot in a housing in plate 24 arranged in a plane parallel with the plane of ski 1, the housing extending parallel with the longitudinal axis XX' of the ski. End-section 25 is extended by an arm 26 running substantially vertically, then by a section 27 located above plate 24. This is extended by a second arm 28 extended in turn by a pivoting section 29 turning in a housing in plate 24 extending parallel with the housing accommodating section 25.

Pivoting section 29 projects towards the rear of the ski and is bent in the form of a handle having a portion 30 in a substantially vertical plane, followed by an end 31 substantially parallel with the plane of the ski.

It is desirable that end 31 be fitted with a sleeve or sheath 32 made, e.g., of a plastic material.

It will be noted that end 31 preferably forms an angle of about 45° with the vertical plane of symmetry of the ski passing through axis XX'.

Location and retention of the boot upon the ski is effected by sleeves 32 bearing against the front end of the sole.

With reference to FIGS. 5 to 9, a description will now be given of the device according to the invention when the rear of the boot is held to the ski.

In all of these embodiments the pressure part is in the form of a jaw which rocks in relation to the ski.

Figure 5:
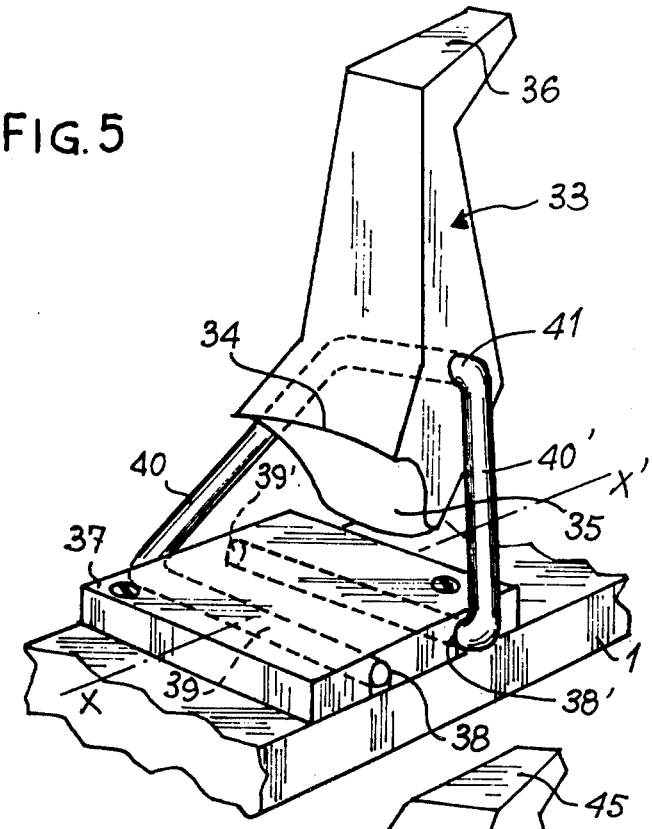
FIG. 5 illustrates an embodiment comprising a jaw designed to cooperate with the rear of the boot.

In FIG. 5, the pressure part, generally marked 33, comprises a jaw 34 designed to cooperate with the top of the sole, an automatic step-in pedal 35, and a lever 36 for voluntarily releasing the boot.

Secured to ski 1 is a base plate 37 having two housings 38,38' of substantially circular cross-section parallel with each other and at right angles to the longitudinal axis XX' of the ski. These housings accommodate pivoting ends 39,39' of a cylindrical rod shaped and bent to provide, as an extension of each end 39,39', arms 40,40', the arms being connected by a cross-piece 41 which is raised above the ski and upon which pressure part 33 is rotatably mounted.

It will be noted that, although in the design shown in FIG. 5, lever 36, which allows the jaw to be opened, is integral with the remainder of the pressure part, the lever could advantageously be hinged in relation to the pressure part, thus pivoting either about cross-piece 41 or about another axis provided for the purpose. The rotary movement of the lever would then be limited by stops integral with the pressure part.

Figure 6:
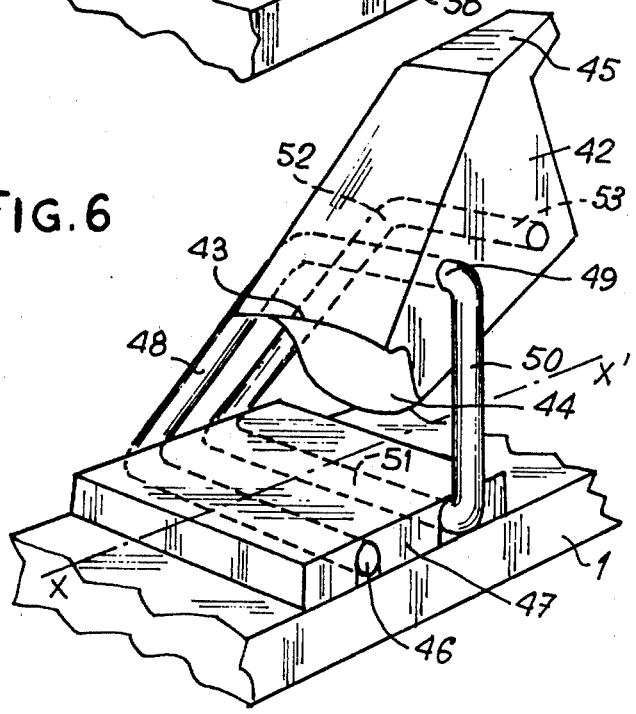
FIG. 6 is a variant of the device illustrated in FIG. 5.

In FIG. 6, pressure part 42, which also comprises a jaw 43, a step-in pedal 44, and a voluntary release lever 45, is supported above ski 1 by a cylindrical rod shaped to form two loops, one connected to the other.

To be more precise, the shaped rod has a first section 46 housed pivotably in a housing in base plate 47. This section is extended by a first arm 48 which is extended, in turn, by a first cross-piece 49, followed by a second arm 50 bent to form a second pivoting section 51 accommodated in base plate 47 in a housing running parallel with the housing accommodating housing 46, and terminating in a cross-piece 53 parallel with cross-piece 49.

Cross-pieces 49 and 53 of the shaped rod are housed so that they turn freely in corresponding passages in pressure part 42.

It will be observed that, in this particular embodiment, sections 46,51 and cross-pieces 49,53 are parallel with, and spaced from, each other and extend at right angles to the longitudinal axis XX' of the ski.

Figure 7:
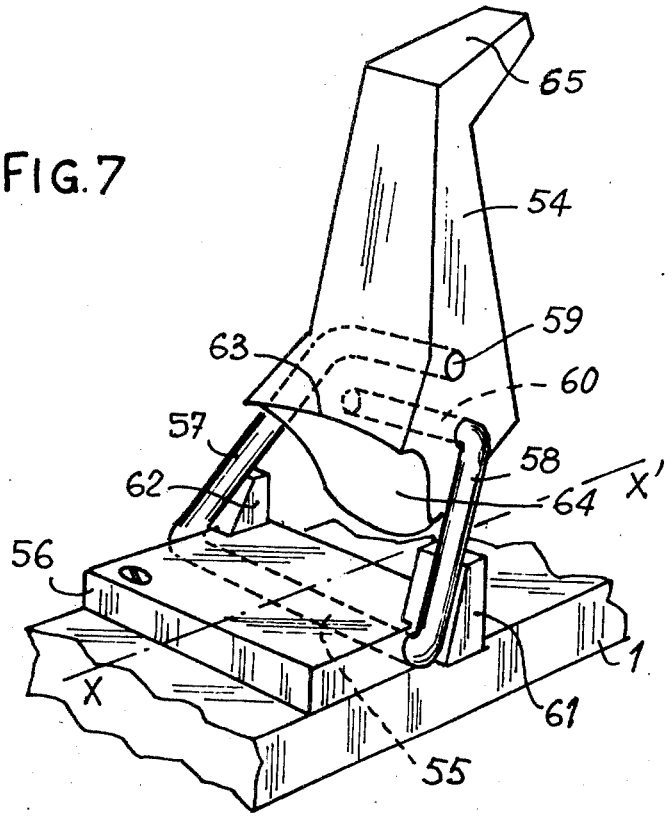
FIG. 7 illustrates a device having a jaw designed to cooperate with the rear of the boot and to provide for safety releases.

In FIG. 7, a pressure part 54, similar to that in FIG. 5, is held above the ski by a shaped cylindrical rod having a cross-piece 55 arranged to rotate freely in a corresponding housing in a base-plate 56 secured to the ski, the cross-piece running at right angles to axis XX' of the ski.

Cross-piece 55 is extended on each side by arms 57,58 bent at their ends to provide pivoting sections 59,60 which are parallel with, and spaced from, each other, the sections being housed rotatably in corresponding housings in pressure part 54.

With the device in its neutral position, in order to prevent the pressure part from dropping onto the ski, stops 61,62 integral with base-plate 56, support lateral arms 57,58 of the shaped rod.

It will be noted that, as in the preceding embodiments, pressure part 54 comprises a jaw 63, an automatic step-in pedal 64, and a lever 65 for manual release.

Figure 8:
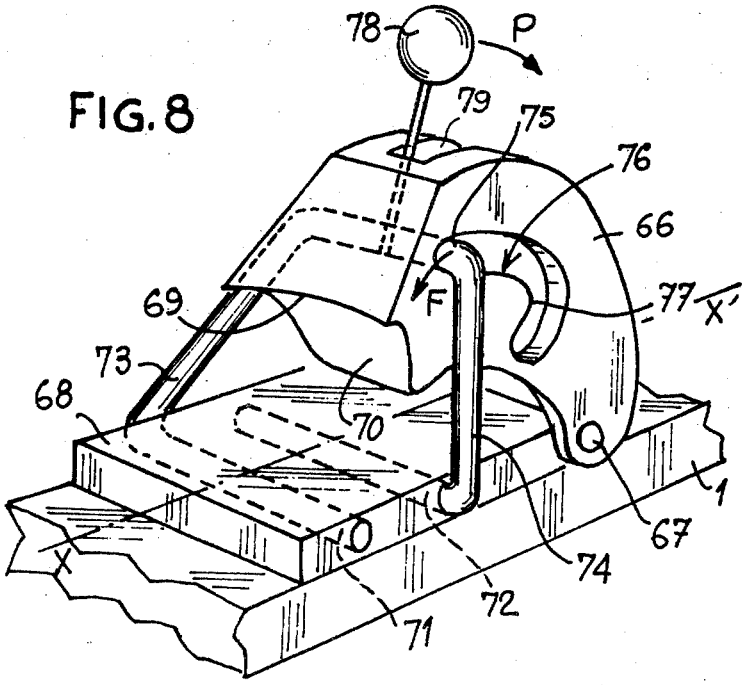
FIGS. 8 and 9 illustrate another embodiment of a device having a jaw designed to cooperate with the rear of the boot, shown in two extreme positions.
Figure 9:
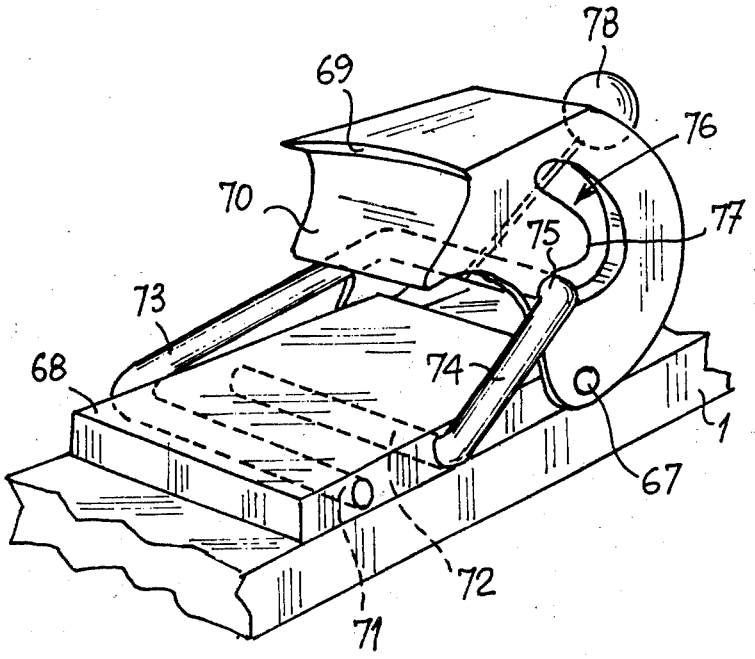

In the embodiment illustrated in FIGS. 8 and 9, a pressure element 66 is arranged to rock about an axis 67 in base-plate 68, the axis running at right angles to the longitudinal axis XX' of the ski. This pressure part has a jaw 69 and an automatic step-in pedal 70, and it cooperates with a resilient means in the form of a cylindrical rod shaped, as in FIG. 5, to form two parallel end-sections perpendicular to the longitudinal axis XX' of the ski, the sections 71,72 being arranged to rotate in corresponding housings in the base-plate.

Each section 71,72 is extended by a lateral arm 73,74 these two arms being arranged on each side of axis XX', and being united by a central cross-piece 75 housed movably in a slot 76 arranged in pressure part 66.

Slot 76 comprises a ramp 77 designed to cooperate with cross-piece 75 in order to hold and release the boot. A manual release lever 78 is integral with cross-piece 75 and extends through a slot 79 in pressure part 66.

In the position shown in FIG. 8, jaw 69 of pressure part 66 holds the boot to the ski, the shaped rod urging the pressure part in the direction of arrow F, since it tends to assume the stable position shown in FIG. 8. The cooperation between cross-piece 75 and ramp 77 thus urges jaw 69 in a downward direction, i.e., into the position in which the boot is held to the ski.

The boot is released against the resilient action of the shaped rod, either by pushing back jaw 69, in the event of a safety release, or by actuating lever 78, in the case of a voluntary release. In the latter case, moving lever 78 in the direction of arrow P causes pressure part 66 to assume the position shown in FIG. 9.

What is claimed is:

1. A device for retaining an object between two elements at least one of which is movable relative to the other, one of said elements being a support means for said object, the other of said elements being a pressure part pivoted in relation to said support means in and out of object retaining position, said device comprising (a) a resilient means having at least one resiliently deformable portion, said resilient means acting between said two elements and applying to said object a resilient force maintaining said object on said support means upon deformation of said at least one resiliently deformable portion, said resilient means comprising (i) two pivoting parts rotatably received in one of said two elements along spaced, substantially parallel axes; and (ii) a connecting part uniting said pivoting parts and connecting said pivoting parts to the other of said elements.

2. A device according to claim 1, wherein the support means has a longitudinal axis in the direction of which the object is to be held, the axes of the pivoting parts extending at right angles to the longitudinal axis of said support means.

3. A device according to claim 1, wherein the pivoting parts are located in a plane parallel with that of said support means.

4. A device according to claim 1, wherein the pressure part is integral with the connecting part of the resilient means uniting the pivoting parts.

5. A device according to claim 1, wherein the resilient means and the pressure part are in the form of a single rod having:

(a) a central loop running above the plane of the element constituting the support means, (b) and said two parallel pivoting parts extending the loop on each side, said pivoting parts being rotatably housed in corresponding housings in said support means, whereby the shaped rod, when mounted upon said support means, exhibits a form of stable equilibrium such that any action upon one part of the rod produces resilient deformation of at least a part thereof.

6. A device according to claim 5, wherein said pivoting parts extend at right angles to the longitudinal axis of said support means, one from one of the lateral sides of said support means, and the other from the other side.

7. A device according to claim 6, wherein said central loop comprises a cross-piece raised above the support means which serves as the pressure part proper, said cross-piece being extended by two arms substantially perpendicular to each of said pivoting parts.

8. A device according to claim 1, wherein said support means has a longitudinal axis, said pivoting parts being located in a plane intersecting the longitudinal axis of said support means.

9. A device according to claim 1, to be used as a front stop for said object, said device comprising two independent shaped rods arranged on each side of the longitudinal axis of the support means.

10. A device according to claim 1, wherein the pressure part comprises an extension of at least one of the pivoting parts.

11. A device according to claim 1, wherein the element constituting the pressure part consists of a jaw which is movable in relation to a support means having a longitudinal axis, said resilient means comprises a central loop raised above the support means, upon which the jaw is mounted to rotate freely, said loop terminating in two cylindrical parts pivotably received in parallel housings in the support means spaced from each other and at right angles to the longitudinal axis of said support means.

12. A device according to claim 1, wherein the element constituting the pressure part consists of a jaw, and wherein the resilient means consists of a single rod shaped to provide:

(a) a first end part pivotably received in a first housing in said support means;

(b) a first intermediate section connected to the first end part and pivotably received in a first housing in the jaw;

(c) a second intermediate part connected to the first intermediate part and pivotably received in a second housing in said support means;

(d) and a second end section connected to the second intermediate part and rotatably received in a second housing in the jaw.

13. A device according to claim 12, wherein said two parts housed in the support means are parallel and perpendicular to the longitudinal axis of the support means.

14. A device according to claim 12, wherein the two parts housed in the jaw are parallel.

15. A device according to claim 12, wherein the parts housed in the jaw are parallel with the parts housed in the support means.

16. A device according to claim 1, wherein the element constituting the pressure part consists of a jaw movable in relation to a means of support having a longitudinal axis, said resilient means being in the form of a single rod shaped to provide:

a central cross-piece mounted rotatably in a housing in the means of support at right angles to the longitudinal axis thereof;

two lateral arms substantially perpendicular to the central cross-piece and extending on each side thereof;

and two end parts extending respectively each of the lateral arms and running substantially parallel with the central cross-piece in housings, spaced from each other, in the jaw.

17. A device according to claim 16, wherein the means of support has stops for the lateral arms of the resilient means, said stops keeping the jaw raised above the ski.

18. A device according to claim 1, wherein the element constituting the pressure part is in the form of a jaw arranged to rock about a transverse axis on the support means, said resilient means being in the form of a single rod shaped to provide:

(a) two substantially parallel end-parts spaced from each other in the direction of the longitudinal axis of the support means and pivotably received in respective housings in said support means;

(b) and a central loop uniting the end parts, said central loop cooperating with a cam on the jaw in order to cause said jaw to rock about its axis when the resilient means is actuated.

19. A device according to claim 18, wherein said central loop is equipped with an operating lever which makes it possible to actuate the resilient means.

* * * * *